US011456540B2

(12) United States Patent
Ado et al.

(10) Patent No.: US 11,456,540 B2
(45) Date of Patent: Sep. 27, 2022

(54) ANTENNA DEVICE AND ANTENNA ADJUSTMENT METHOD

(71) Applicant: Mitsubishi Electric Corporation, Tokyo (JP)

(72) Inventors: Hiroto Ado, Tokyo (JP); Shuji Nuimura, Tokyo (JP); Tomohiro Mizuno, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 34 days.

(21) Appl. No.: 17/279,094

(22) PCT Filed: Aug. 8, 2019

(86) PCT No.: PCT/JP2019/031500
§ 371 (c)(1),
(2) Date: Mar. 24, 2021

(87) PCT Pub. No.: WO2020/110375
PCT Pub. Date: Jun. 4, 2020

(65) Prior Publication Data

US 2022/0052459 A1 Feb. 17, 2022

(30) Foreign Application Priority Data

Nov. 27, 2018 (JP) ..... JP2018-221095

(51) Int. Cl.
*H01Q 19/18* (2006.01)
*H01Q 15/16* (2006.01)

(52) U.S. Cl.
CPC ..... *H01Q 19/18* (2013.01); *H01Q 15/161* (2013.01)

(58) Field of Classification Search
CPC ..... H01Q 19/18; H01Q 19/19; H01Q 15/147; H01Q 15/161; H01Q 3/01
See application file for complete search history.

(56) References Cited

U.S. PATENT DOCUMENTS 6,288,683 B1 9/2001 Deguchi et al.
2018/0109002 A1* 4/2018 Foo ..... H01Q 19/19

FOREIGN PATENT DOCUMENTS

JP 5-75336 A 3/1993
JP 6-291541 A 10/1994
(Continued)

OTHER PUBLICATIONS

International Search Report and Written Opinion dated Oct. 8, 2019, received for PCT Application PCT/JP2019/031500 Filed on Aug. 8, 2019, 9 pages including English Translation.
(Continued)

*Primary Examiner* — Daniel Munoz
(74) *Attorney, Agent, or Firm* — Xsensus LLP

(57) ABSTRACT

An antenna device includes a main reflector (11), a sub-reflector (12) including sub-reflector panels and having a reflecting surface facing a reflecting surface of the main reflector, and a primary emitter (13) to receive a radio wave reflected by the sub-reflector (12). Each of sub-reflector panel drive mechanisms coupled to the sub-reflector panels is finely driven. A phase calculator (171) calculates a relative phase of an element electric-field vector corresponding to each of the sub-reflector panels based on a change in received electric-field strength of the radio wave received by the primary emitter (13) during driving of the sub-reflector panel drive mechanisms, and determines positions of the sub-reflector panels at which a phase distribution on an aperture surface of the main reflector (11) is minimized.

17 Claims, 7 Drawing Sheets

(56) References Cited

FOREIGN PATENT DOCUMENTS

| | | | |
|---|---|---|---|
| JP | 2000-201019 | A | 7/2000 |
| JP | 2001-196842 | A | 7/2001 |
| JP | 4109722 | B2 | 7/2008 |

OTHER PUBLICATIONS

Notice of Reasons for Refusal dated Jan. 19, 2021, received for JP Application 2020-558089, 8 pages including English Translation.

Zheng-Xiong et al., "The position and Attitude of Sub-Reflector Modeling forTM65m Radio Telescope", Asia-Pacific Microwave Conference (APMC), vol. 1, 2015, 3 pages.

* cited by examiner

ANTENNA DEVICE AND ANTENNA ADJUSTMENT METHOD

CROSS-REFERENCE TO RELATED APPLICATIONS

The present application is based on PCT filing PCT/JP2019/031500, filed Aug. 8, 2019, which claims priority to JP 2018-221095, filed on Nov. 27, 2018, the entire contents of each are incorporated herein by reference.

TECHNICAL FIELD

The present disclosure relates to an antenna device and an antenna adjustment method that are to perform transmission and reception using a main reflector and a sub-reflector.

BACKGROUND ART

A large antenna device that performs transmission and reception by reflection by a main reflector and the sub-reflector is sometimes used at a ground station of a satellite communication system. Techniques for adjusting a position, an orientation and a shape of an antenna in order to improve aperture efficiency of the main reflector and directionality toward a wave source are known (for example, Patent Literatures 1 and 2 and Non-Patent Literature 1).

Patent Literature 1 discloses a modular antenna including (i) a main reflector including main reflector constituting modules and (ii) a sub-reflector including sub-reflector constituting modules, wherein each of the sub-reflector constituting modules is driven by three actuators. Patent Literature 1 mentions that this configuration compensates for a positional error of the modular antenna by the drive mechanism of the sub-reflector, so that the weight and the structure can be reduced or simplified as compared with the case in which the drive mechanism is mounted on the main reflector.

Also, Patent Literature 2 discloses an antenna mirror surface measuring/adjusting device, wherein (i) a plane mirror is larger than an aperture surface of a main reflector and is disposed parallel to the aperture surface, and (ii) an actuator installed on each mirror surface panel of the main reflector is driven stepwise to adjust a position of the mirror surface panel. Patent Literature 2 states that, every time a position of the mirror surface panel is changed, mirror surface adjustment can be made based on a phase distribution on an aperture surface of the main reflector that is obtained from a radio signal that returns by reflecting, by the plane mirror, a radio wave emitted from transmission/reception means.

Also, Non-Patent Literature 1 discloses a technique for compensating for aberrations by adjusting a position of a sub-reflector to a suitable position with respect to a mirror surface of a main reflector that is deformed by its own weight in a large-diameter ground station antenna.

CITATION LIST

Patent Literature

Patent Literature 1: Unexamined Japanese Patent Application Publication No. H06-291541

Patent Literature 2: Japanese Patent No. 4109722

Non-Patent Literature 1: Sun Zheng-xiong, Wang Jin-qing, and Chen Lan, "The position and attitude of sub-reflector modeling for TM65m Radio Telescope", 2015 Asia-Pacific Microwave Conference (APMC), Year: 2015, Volume: 1

SUMMARY OF INVENTION

Technical Problem

In an antenna device having a large-diameter main reflector, there is a problem in that, when the direction of orientation is changed in an elevation direction, aberration occurs due to self-weight deformation of the main reflector, so the phase at an aperture surface becomes non-uniform and aperture efficiency deteriorates.

Since the modular antenna disclosed in Patent Literature 1 is assumed to be mounted on a satellite, position adjustment is made only by driving an actuator. However, this modular antenna cannot cope with self-weight deformation specific to a large-diameter main reflector of an antenna arranged at a ground station. Also, how to determine suitable positions of the sub-reflector constituting modules with respect to a positional error of the main reflector is unclear.

Also, in the antenna mirror surface measuring/adjusting device disclosed in Patent Literature 2, the drive mechanism is provided on each panel of the mirror surface that is included in the main reflector. As a result, there is a problem in that the number of panels of the large-diameter main reflector and the number of necessary drive mechanisms are large, and thus the cost becomes high. Additionally, installation of a plane mirror larger than the main reflector is not realistic, and there is a problem in that, particularly in a case in which the plane mirror has an elevation angle formed with the vertical direction or the horizontal direction, the installation of the plane mirror is difficult, and the elevation angle characteristic cannot be measured.

Also, in a case in which, as in Non-Patent Literature 1, the entire sub-reflector is moved to a main focal position of the large-diameter main reflector that is deformed due to its own weight, there is a problem in that aberrations in the circumferential direction and the radial direction of the mirror surface of the main reflector remain.

In consideration of such circumstances, an object of the present disclosure is to provide an antenna device and an antenna adjustment method that enable easy adjustment of a sub-reflector with high accuracy, without adjustment of a main reflector, and at low cost.

Solution to Problem

In order to achieve the above objective, an antenna device according to the present disclosure includes (i) a main reflector, (ii) a sub-reflector including sub-reflector panels and having a reflecting surface facing a reflecting surface of the main reflector, (iii) a primary emitter to receive a radio wave reflected by the sub-reflector, and (iv) sub-reflector panel drive mechanisms to drive the sub-reflector panels, the sub-reflector panel drive mechanisms being coupled to the sub-reflector panels. Additionally, the antenna device is characterized in that a phase calculator (i) calculates a relative phase of an element electric-field vector corresponding to each of the sub-reflector panels based on a change in received electric-field strength of the radio wave received by the primary emitter during driving of the sub-reflector panel drive mechanisms and (ii) determines positions of the sub-reflector panels at which a phase distribution on an aperture surface of the main reflector is minimized.

Advantageous Effects of Invention

According to the present disclosure, the phase distribution on the aperture surface is reduced by driving each of the sub-reflector panels constituting the sub-reflector smaller than the main reflector, thereby enabling compensation for aberration due to deformation of the main reflector. Accordingly, the sub-reflector can be easily adjusted with high accuracy, without adjustment of the main reflector, and at low cost.

DESCRIPTION OF EMBODIMENTS

Embodiment

An embodiment for achieving the present disclosure is described below in detail with reference to the drawings.

Figure 1:
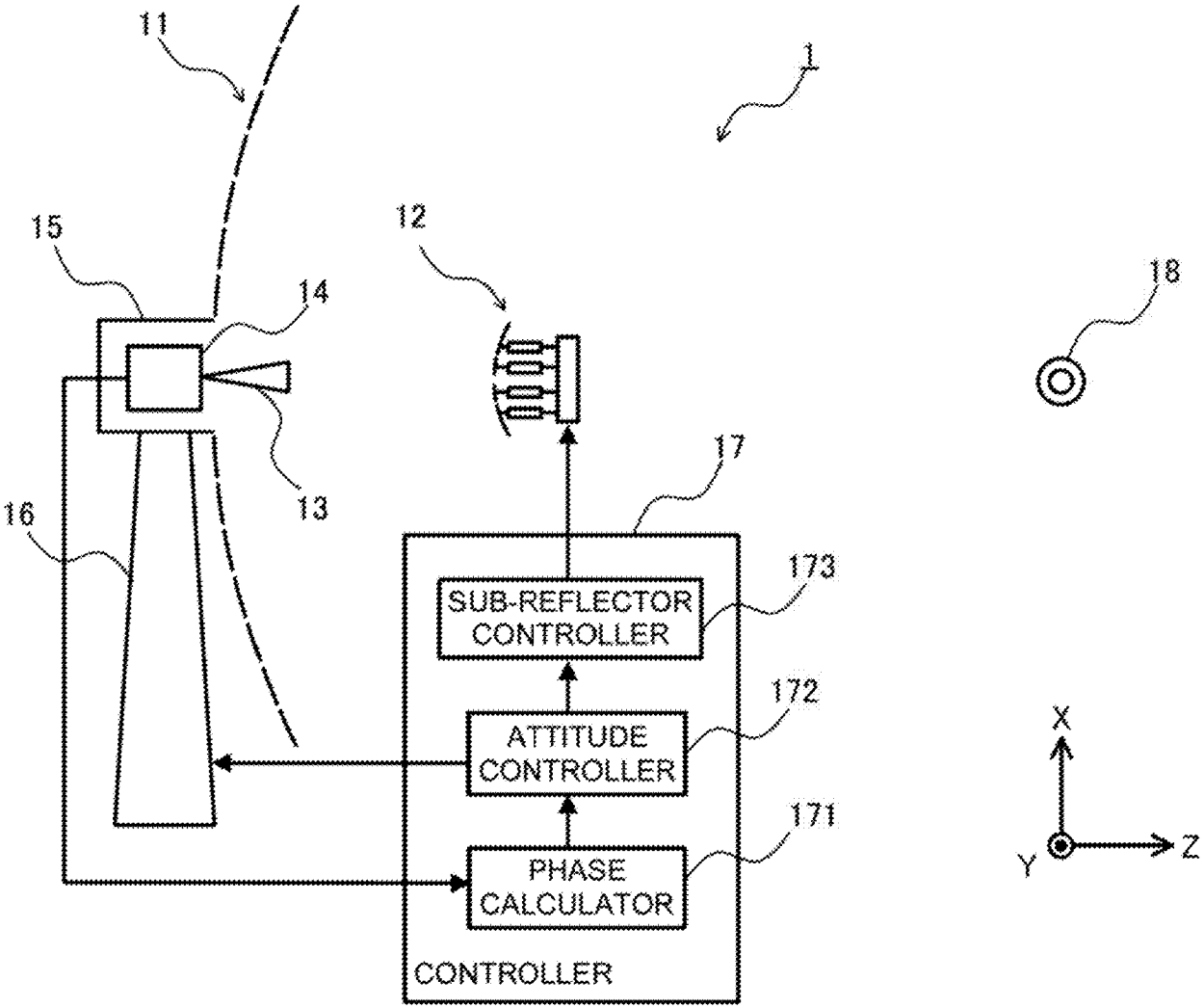
FIG. 1 is a schematic view of an antenna device according to an embodiment of the present disclosure.

FIG. 1 is a schematic view of an antenna device 1 according to the present embodiment. As illustrated in FIG. 1, the antenna device 1 includes (i) a main reflector 11, (ii) a sub-reflector 12 having a reflecting surface that faces a reflecting surface of the main reflector 11, (iii) a primary emitter 13 facing the reflecting surface of the sub-reflector 12, and (iv) a transceiver 14 connected to the primary emitter 13. The antenna device 1 further includes (v) an elevation angle driver 15 that drives the main reflector in an elevation direction, (vi) an azimuth angle driver 16 that drives the main reflector 11 in an azimuth direction, and (vii) a controller 17 that controls driving of the main reflector 11 and driving of the sub-reflector 12.

The antenna device 1 receives a radio wave emitted from a wave source 18 located at a point that is so distant from the antenna device 1 as to be located in the far field. The wave source 18 is a freely-selected wave source that emits a continuous wave with minute changes in position and in transmission power in a short time, and the wave source 18 is, for example, a satellite, a radio star, or a collimation antenna. Also, the antenna device 1 transmits a radio wave to the wave source 18 existing in the far field.

In the present embodiment, the main reflector 11 includes main reflector panels, and the overall arrangement of the main reflector panels forms a paraboloid. The primary emitter 13 and the transceiver 14 are located in the center of the main reflector 11.

Figure 2:
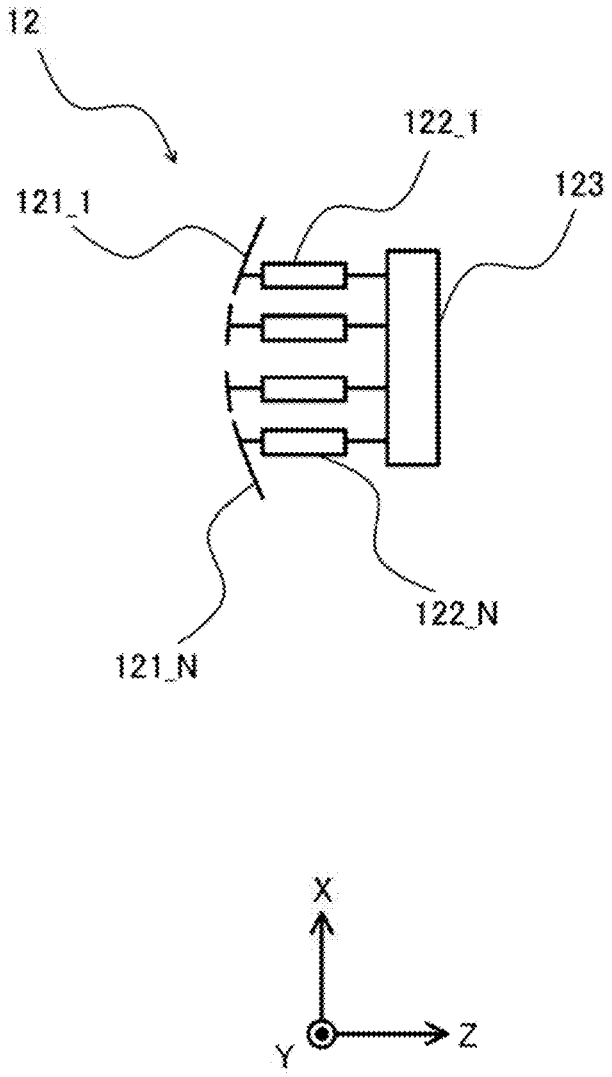
FIG. 2 is an enlarged view of a sub-reflector.

FIG. 2 is an enlarged view of the sub-reflector 12. As illustrated in FIG. 2, the sub-reflector 12 includes N sub-reflector panels 121_1 to 121_N, and the arranged sub-reflector panels 121_1 to 121_N form a hyperboloid as a whole, where N is an integer equal to or greater than two. The sub-reflector 12 has a first focus of two foci of the hyperboloid within a certain range including a focus of the paraboloid of the main reflector 11.

The sub-reflector 12 is provided with N sub-reflector panel drive mechanisms 122_1 to 122_N respectively coupled to the sub-reflector panels 121_1 to 121_N to respectively drive the sub-reflector panels 121_1 to 121_N, and is provided with a sub-reflector drive mechanism 123 that drives the entire sub-reflector 12, The sub-reflector panel drive mechanisms 122_1 to 122_N can respectively drive the sub-reflector panels 121_1 to 121_N in a direction along the central axis connecting the two foci of the hyperboloid. Also, as illustrated in FIG. 2, when a driving direction of the sub-reflector panel drive mechanisms 122_1 to 122_N is assumed to be the Z-axis direction, the sub-reflector drive mechanism 123 can drive the entire sub-reflector 12 in the X-axis direction, in the Z-axis direction, and in a direction of rotation about the Y axis.

The primary emitter 13 is located within a certain range including a second focus of the hyperboloid of the sub-reflector 12. The primary emitter 13 (i) receives a radio wave coming from the wave source 18 and reflected by the main reflector 11 and the sub-reflector 12 and (ii) outputs the radio wave to the transceiver 14. Also, the primary emitter 13 emits, toward the sub-reflector 12, the radio wave transmitted from the transceiver 14. The radio wave emitted from the primary emitter 13 is reflected by the sub-reflector 12 and the main reflector 11 to be transmitted toward the wave source 18 existing in the far field. The primary emitter 13 is a freely-selected antenna module, for example, a horn antenna that widens in a conical shape or a pyramidal shape toward a tip on the side of the sub-reflector 12.

The elevation angle driver 15 drives the main reflector 11 in the elevation direction that is the direction of rotation about the Y axis in FIG. 1. The azimuth angle driver 16 drives the main reflector 11 in the azimuth direction that is a direction of rotation about the vertical direction. As a result, the main reflector 11 can orient the aperture surface at a freely-selected elevation angle and at a freely-selected azimuth angle. Here, the aperture surface is an imaginary surface that is located at an aperture position of the paraboloid of the main reflector 11 and is perpendicular to the direction of orientation toward the wave source 18.

The controller 17 controls attitudes of the main reflector 11 and the sub-reflector 12 based on received signals received by the transceiver 14. The controller 17 includes (i) a phase calculator 171 that calculates phases using the received signals by applying the rotating element electric-field vector method, (ii) an attitude controller 172 that generates, based on information including a result of calculation by the phase calculator 171, information of attitudes of the main reflector 11 and the sub-reflector 12, and (iii) a sub-reflector controller 173 that controls driving of the sub-reflector 12 based on the information of attitude of the sub-reflector 12 generated by the attitude controller 172.

Operation of the antenna device 1 configured as above is described.

In the antenna device 1, the main reflector 11 forms an ideal paraboloid in an initial state in which the antenna device 1 is oriented in a preset elevation direction. When the antenna device 1 is driven in the elevation direction from the initial state, the direction of gravity with respect to the mirror surface of each of the main reflector panels of the main reflector 11 changes, so that the main reflector 11 is deformed from the ideal paraboloid due to self-weight deformation.

Figure 3:
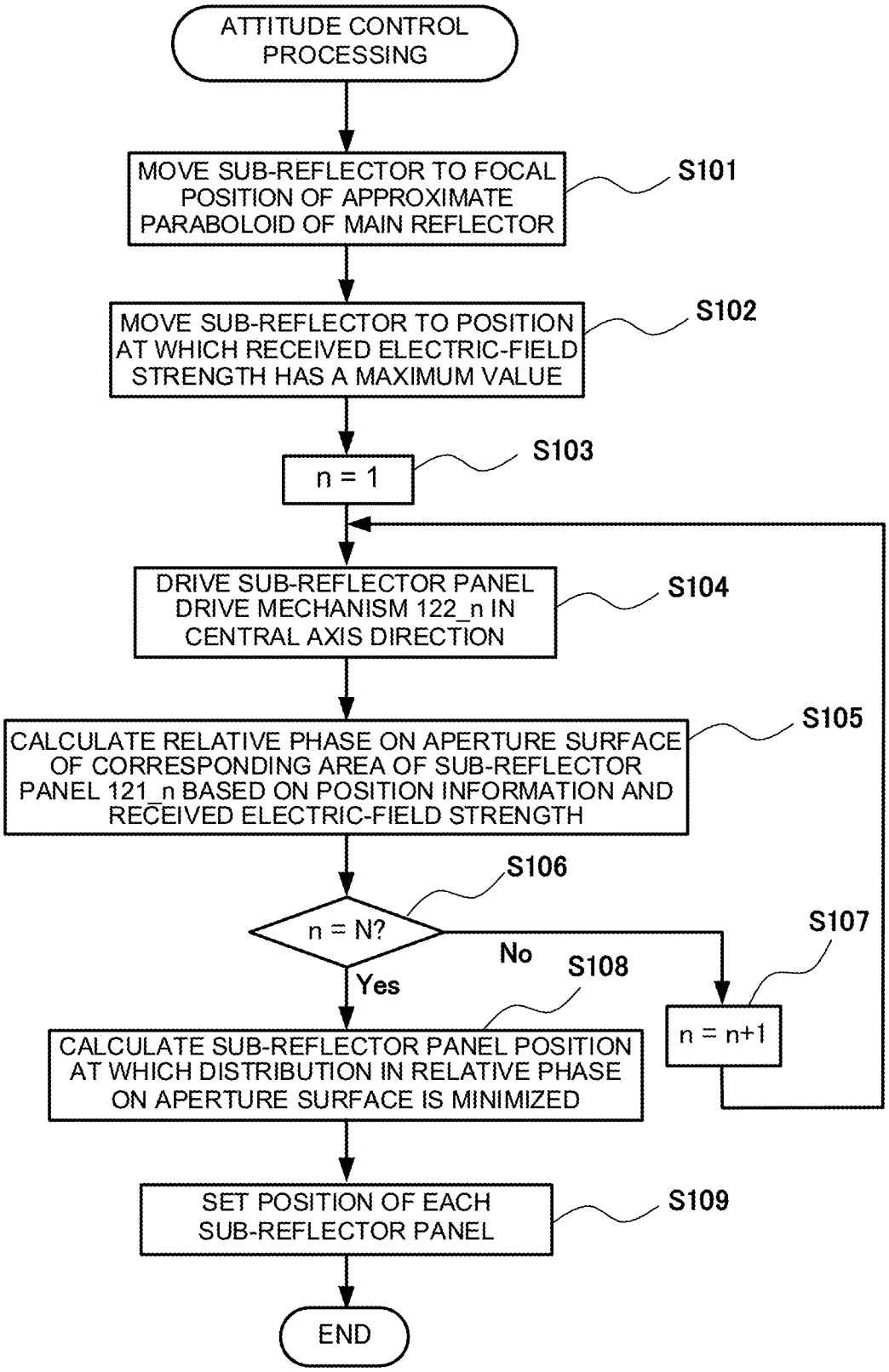
FIG. 3 is a flowchart illustrating attitude control processing.

The deformation of the main reflector 11 causes an aberration in the propagation distance of the radio wave, and variation occurs in the phase distribution on the aperture surface, so that the aperture efficiency of the antenna device 1 deteriorates. The controller 17 executes attitude control processing for compensating for the aberration caused by the self-weight deformation of the main reflector 11. The attitude control processing is described with reference to FIG. 3. FIG. 3 is a flowchart illustrating the attitude control processing executed by the controller 17.

The attitude control processing illustrated in FIG. 3 starts when a direction of orientation of the main reflector 11 is changed in order to orient the main reflector 11 to the wave source 18. Since the sub-reflector 12 is fixed relative to the main reflector 11, when the direction of orientation of the main reflector 11 is changed, a direction of orientation of the sub-reflector 12 is also changed in conjunction with the change in the direction of orientation of the main reflector. However, when the shape of the main reflector 11 changes from the ideal paraboloid, the sub-reflector 12 deviates from an optimum position. The attitude control processing is a process of optimizing the position, orientation, and shape of the sub-reflector 12.

First, the attitude controller 172 of the controller 17 acquires the shape of the main reflector 11 deformed due to weight thereof, calculates an approximate paraboloid from the acquired shape, and outputs a focal position. The method of acquiring the shape of the main reflector 11 may be a freely-selected conventional method. For example, the antenna device may be oriented at various elevation angles in advance, and the shape may be acquired based on a captured image captured by a camera. Also, the method of calculating the approximate paraboloid may be a freely-selected conventional method. For example, the approximate paraboloid may be calculated using the least squares method for the acquired shape of the main reflector 11.

The sub-reflector controller 173 drives the sub-reflector drive mechanism 123 of the sub-reflector 12 to move the entire sub-reflector 12 to the focal position output by the attitude controller 172 (step S101). As a result, a position of the sub-reflector 12 relative to the main reflector 11 changes, and rough defocus adjustment is made to cause a position of the sub-reflector 12 to match the calculated focal position of the main reflector 11.

Next, in a state in which the main reflector 11 is oriented toward the wave source 18, the sub-reflector drive mechanism 123 is finely driven in a direction of each drive axis by control of the attitude controller 172 and the sub-reflector controller 173, and a position at which received electric-field strength received by the transceiver 14 has a maximum value is determined. The sub-reflector controller 173 moves the entire sub-reflector 12 to the determined position (step S102). Aberration compensation for the main reflector 11 is adjusted by this process from the viewpoint of the received electric-field strength.

The processing up to step S102 enables the focus of the sub-reflector 12 to match the focal position of the approximate paraboloid of the main reflector 11. However, deformation of the main reflector 11 in the radial direction and the circumferential direction, such as deformation represented by the Zernike approximation polynomial, occurs and an aberration due to this deformation remains.

Accordingly, compensation for the residual aberrations is performed by adjusting positions of the sub-reflector panels 121_1 to 121_N. At that time, the phase calculator 171 regards the sub-reflector panels **121_*n*, where n is a freely-selected integer among the integers 1 to N, as N antenna elements and applies the rotating element electric-field vector method, thereby estimating relative phases on the aperture surface corresponding to panel areas of the main reflector 11 irradiated with radio waves from the respective sub-reflector panels 121_*n*. The use of this relative phase enables achievement of aberration compensation without measuring an aperture distribution of the antenna device 1. This aberration compensation is executed in steps S103 to S109**.

First, the attitude controller 172 sets the integer n to be one (step S103). Next, the sub-reflector panel drive mechanism **122_*n* discretely shifts, based on control of the sub-reflector controller 173, the position of the sub-reflector panel 121_*n* in increments smaller than ⅛ of a wavelength of a received radio wave, thereby causing movement by half a wavelength or more in the direction of the central axis connecting the two foci of the hyperboloid (step S104). The phase calculator 171** obtains the received electric-field strength at each position.

The phase calculator 171 uses the rotating element electric-field vector method to obtain, from the position information of the sub-reflector panel **121_*n* and the received electric-field strength of the radio wave received by the transceiver 14 at each position, the relative phase on the aperture surface in the area corresponding to the sub-reflector panel 121_*n* in the initial state (step S105**).

Afterward, when n is not N (No in step S106), n is incremented by 1 (step S107) and the processing returns to step S104. In this way, the processes of steps S104 to S107 are repeated. When n becomes N (Yes in step S106), the phase calculator 171 calculates relative phases of the element electric-field vectors corresponding to the sub-reflector panels 121_1 to 121_N, thereby obtaining the phase distribution.

The phase calculator 171 calculates positions of the sub-reflector panels **121_*n* at which the distribution is minimized for the relative phases on the aperture surface corresponding to the panel areas of the main reflector 11 irradiated with the radio waves from the sub-reflector panels 121_*n* (Step S108). The attitude controller 172 outputs, based on a result of calculation by the phase calculator 171, the position information of the sub-reflector panels 121_*n* to the sub-reflector controller 173. The sub-reflector controller 173 drives the sub-reflector panel drive mechanisms 122_*n* to set the positions of the sub-reflector panels 121_*n* (step S109**).

Figure 4:
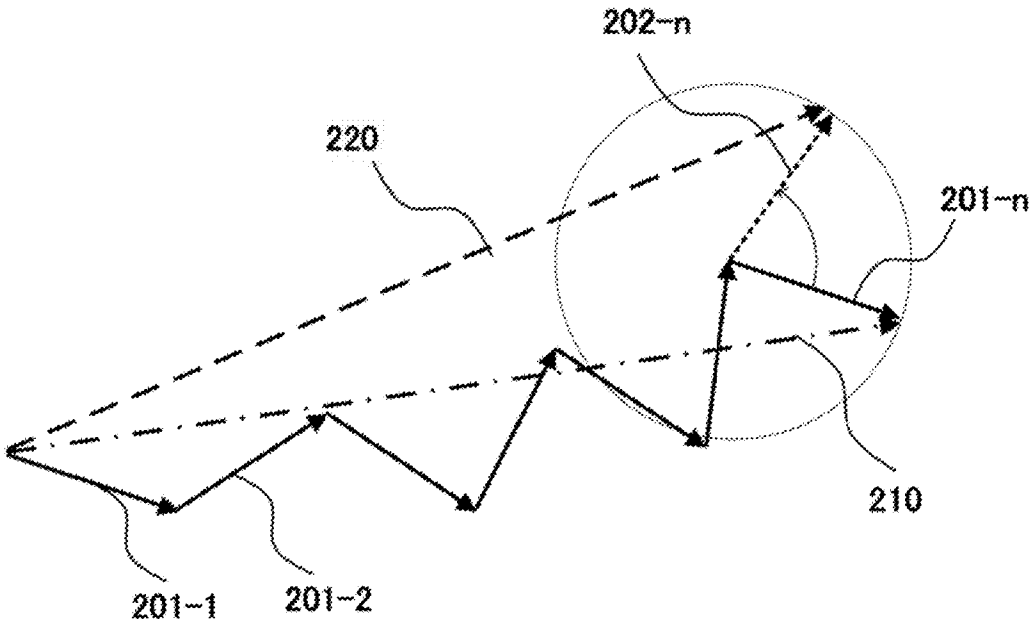
FIG. 4 is a view illustrating element electric-field vectors and resultant electric-field vectors before aberration compensation.

The effect of minimizing the distribution in relative phase is described with reference to FIGS. 4 and 5. FIG. 4 is a view illustrating element electric-field vectors **201_*n* before aberration compensation and resultant electric-field vectors 210 and 220. As illustrated in FIG. 4, the sub-reflector panel 121_*n* is moved in the direction of the central axis of the hyperboloid to change the phase of the element electric-field vector 201_*n* to the element electric field vector 202_*n*, thereby enabling the direction of the resultant electric-field vector 210 to be oriented in the direction of the resultant electric-field vector 220 that is a predetermined direction. However, the directivity and magnitude of the resultant electric-field vector 220** are not optimal due to the distribution in the relative phases on the aperture surface.

On the other hand, in the present embodiment, the phase calculator 171 performs calculation using the rotating element electric-field vector method, thereby estimating the relative phases on the aperture surface corresponding to the panel areas of the main reflector 11 irradiated with the radio waves from the sub-reflector panels **121_*n*. Additionally, the phase calculator determines the position of each of the sub-reflector panels 121**_*n* at which the distribution in the relative phases is minimized in the state where the resultant electric-field vector 220 is oriented in a predetermined direction. As a result, the aberration compensation can be made without measuring the aperture distribution of the antenna device 1.

Figure 5:
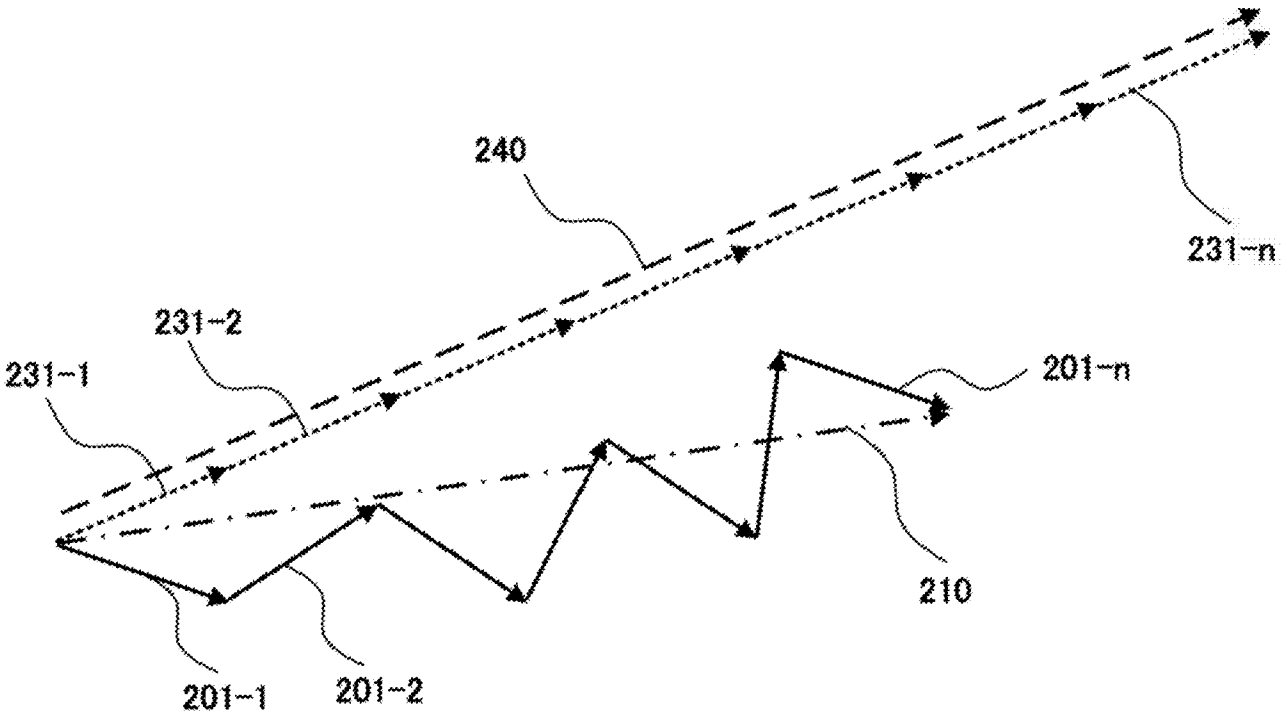
FIG. 5 is a view illustrating element electric-field vectors and resultant electric-field vectors after aberration compensation.

FIG. 5 illustrates element electric-field vectors 231_*n* and a resultant electric-field vector 240 after aberration compensation. The relative phases of the element electric-field vectors 231_*n* corresponding to the sub-reflector panels 121_*n* are made to match one another, thereby obtaining the resultant electric-field vector 240 that compensates for an aberration caused by the self-weight deformation of the main reflector 11, thereby enabling improvement of the aperture efficiency of the antenna.

If the radio star or the satellite is the wave source, the elevation angle varies in accordance with the wave source, and the self-weight deformation of the main reflector 11 also varies. However, according to the present embodiment, aberration compensation can be made without depending on the elevation angle. In the present embodiment, each of the sub-reflector panels 121_1 to 121_N is provided with a driving mechanism to compensate for the aberration, so that the aberration compensation can be made at a lower cost than the case in which the panels of the main reflector 11 are provided with the driving mechanisms, and reliability is also improved.

Also, an area of the aperture surface corresponding to each panel of the sub-reflector 12 is wider than that of the main reflector 11. Accordingly, in the case in which the sub-reflector 12 is provided with the driving mechanisms, the element electric-field vectors change more when the panels are moved in comparison to the case in which the main reflector 11 is provided with the driving mechanisms, and there is also an advantage that measurement accuracy is easy to improve in a case of the use of the rotating element electric-field vector method.

As described above, the antenna device 1 according to the present embodiment includes (i) the main reflector 11, (ii) the sub-reflector 12 that includes the sub-reflector panels 121_*n* and has the reflecting surface facing the reflecting surface of the main reflector 11, and (iii) the primary emitter 13 that receives a radio wave reflected by the sub-reflector 12. The attitude controller 172 calculates the approximate paraboloid from the shape of the main reflector 11 that is driven in the elevation direction, and the sub-reflector drive mechanism 123 moves the sub-reflector 12 to the focal position of the approximate paraboloid. Also, the sub-reflector drive mechanism 123 moves the sub-reflector 12 to the position at which the received electric-field strength has a maximum value. Additionally, the phase calculator 171 (i) calculates, based on the change in the received electric-field strength of a radio wave received by the primary emitter 13 during fine driving of each of the sub-reflector panel drive mechanisms 122_*n* respectively coupled to the sub-reflector panels 121_*n*, the relative phases of the element electric-field vectors corresponding to the sub-reflector panels 121_*n* and (ii) determines the positions of the sub-reflector panels 121_*n* at which the phase distribution on the aperture surface of the main reflector 11 is minimized. As a result, the sub-reflector 12 can be easily adjusted with high accuracy, without adjustment of the main reflector 11 and at low cost.

As described above, according to the present disclosure, the antenna device 1 includes (i) the main reflector, (ii) the sub-reflector that includes the sub-reflector panels and has the reflecting surface facing the reflecting surface of the main reflector, (iii) the primary emitter that receives a radio wave reflected by the sub-reflector, and (iv) the sub-reflector panel drive mechanisms that are coupled to the sub-reflector panels and drive the sub-reflector panels. Additionally, the phase calculator (i) calculates, based on the change in the received electric-field strength of the radio wave received by the primary emitter during driving of the sub-reflector panel drive mechanisms, the relative phases of the element electric-field vectors corresponding to the sub-reflector panels and (ii) determines the positions of the sub-reflector panels at which the phase distribution on the aperture surface of the main reflector is minimized. As a result, the sub-reflector can be easily adjusted with high accuracy, without adjustment of the main reflector and at low cost.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

Figure 6:
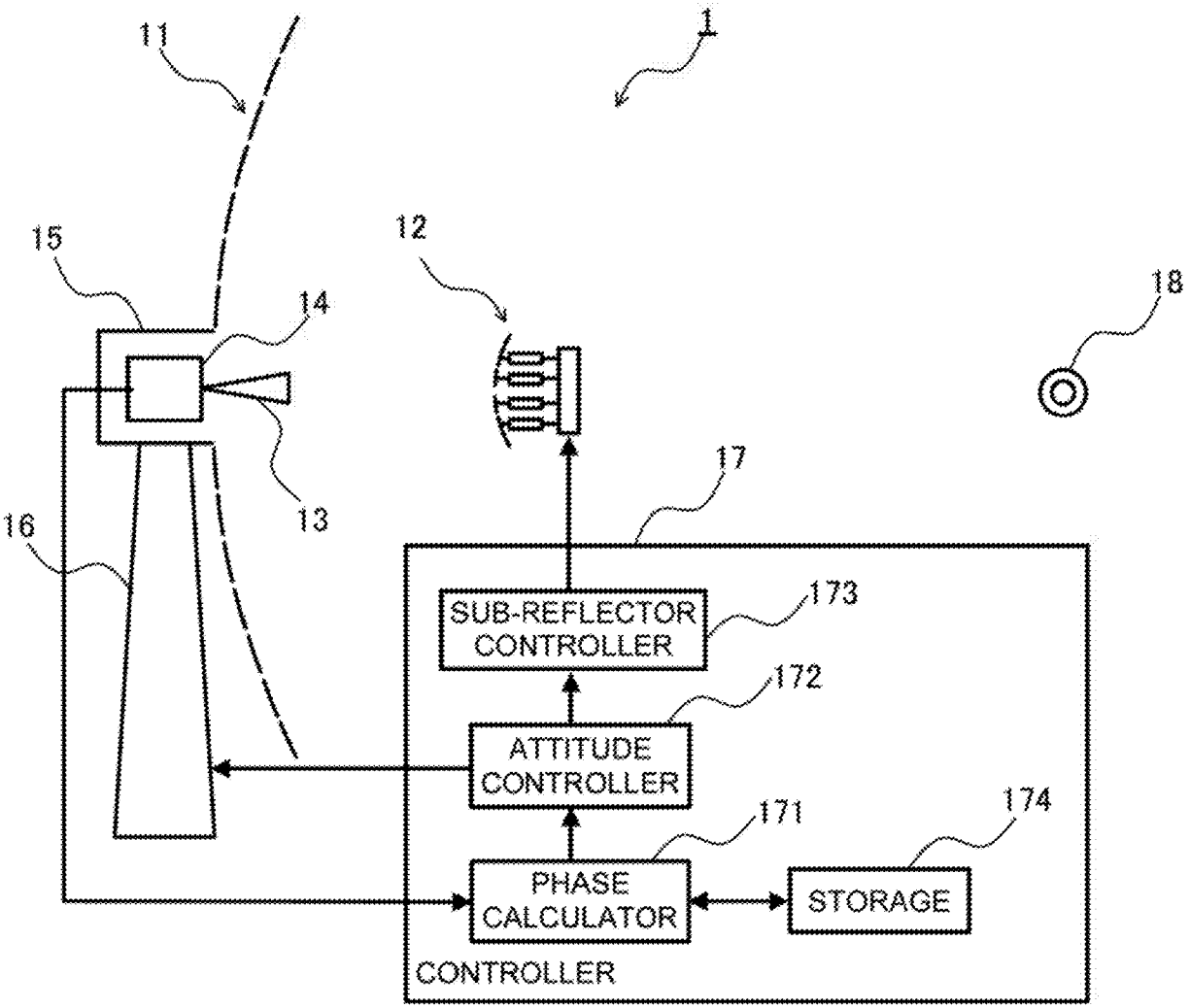
FIG. 6 is a schematic view of an antenna device according to another embodiment.

For example, in the above-described embodiment, when the main reflector 11 is moved in the elevation direction, the sub-reflector panel drive mechanisms 122_*n* and the sub-reflector drive mechanism 123 are driven to finely adjust the positions of the sub-reflector panels 121_*n*, so that the phase calculator 171 obtains the positions of the sub-reflector panels 121_*n* for which an aberration is compensated. On the other hand, as illustrated in FIG. 6, the phase calculator 171 may be configured to (i) obtain the positions of the sub-reflector panels 121_*n* for which the aberration is compensated when the main reflector 11 is moved in multiple elevation angle directions in advance and (ii) store information of the positions in a storage 174. In this case, the phase calculator 171 calculates, based on: the information of the positions corresponding to the elevation angle stored in the storage 174 and the elevation angle of the main reflector 11, the positions of the sub-reflector panels 121_*n* for which the aberration compensation is made approximately at a freely-selected elevation angle. As a result, the processing in a case of a change in direction of the main reflector 11 can be simplified.

Also, in the attitude control processing illustrated in FIG. 3, before the sub-reflector panel drive mechanisms 122_*n* are driven in steps S103 to S109 to execute the process of compensating for an aberration, the sub-reflector drive mechanism 123 is driven in steps S101 and S102 to change the position of the entire sub-reflector 12. However, execution of one or both of the processes in step S101 and step S102 may be omitted. As a result, an operating time can be shortened when a difference in position of the sub-reflector 12 is small.

Figure 7:
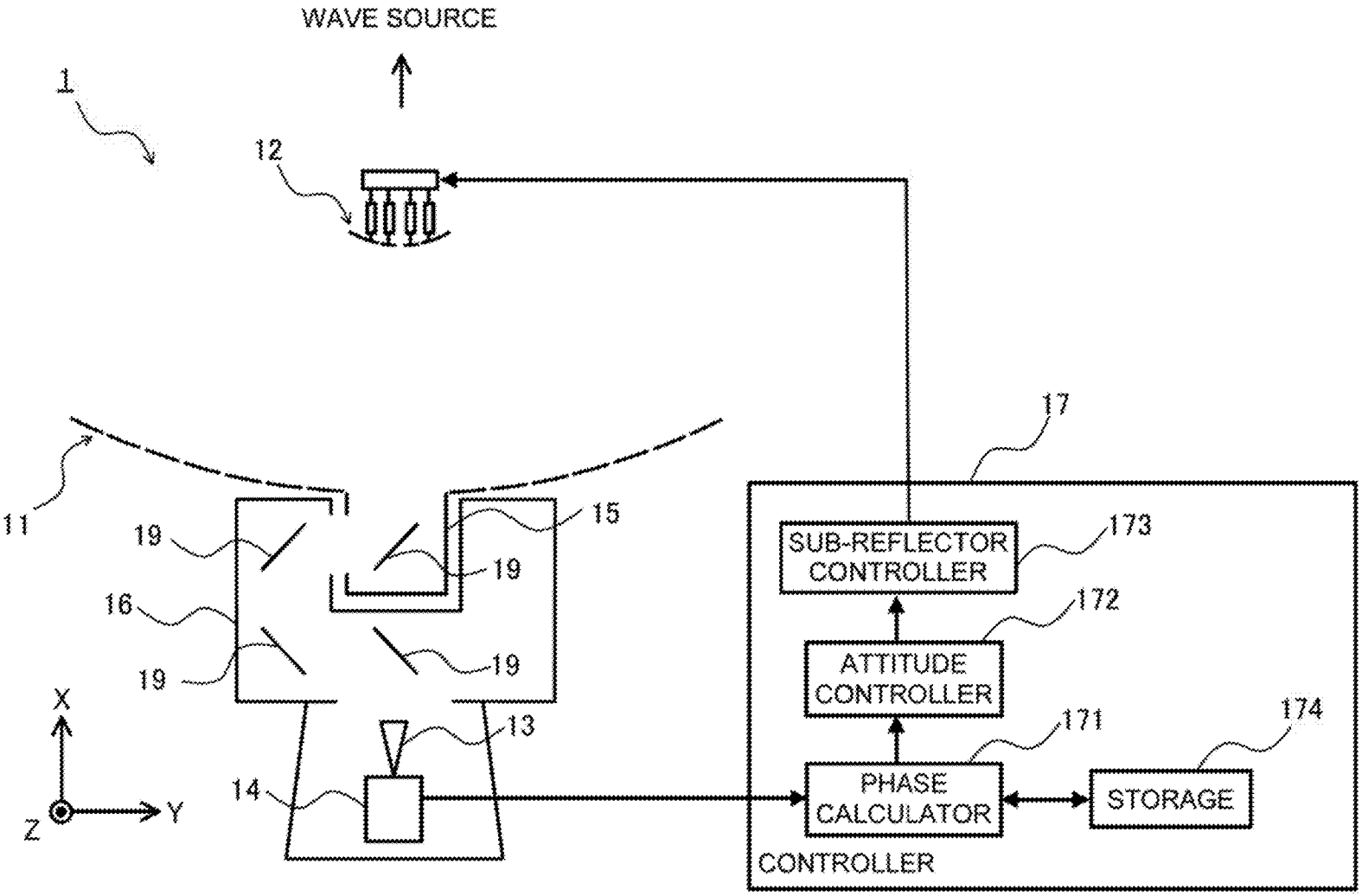
FIG. 7 is a schematic view of an antenna device according to another embodiment.

Also, a radio wave reflected by the sub-reflector 12 is made directly incident on the primary emitter 13 or a radio wave emitted from the primary emitter 13 is made directly incident on the sub-reflector 12. However, the antenna device 1 may be provided with one or more focusing reflectors 19 between the sub-reflector 12 and the primary emitter 13. FIG. 7 illustrates a case where four focusing reflectors 19 are provided. FIG. 7 illustrates a state in which the elevation angle driver 15 drives the main reflector 11 in the elevation direction that is the direction of rotation about the Y axis illustrated in the drawing and the main reflector 11 faces vertically upward. In this case, one of the focusing reflectors 19 is provided in the elevation angle driver 15, and three of the focusing reflectors 19 are provided in the azimuth angle driver 16. The radio wave entering from the sub-reflector 12 is reflected by the focusing reflectors 19 and focused on a phase center of the primary emitter 13. As a result, coupling efficiency between the sub-reflector 12 and the primary emitter 13 is improved, and the aperture efficiency of the antenna device 1 can be improved.

The positions of the focusing reflectors 19 relative to the elevation angle driver 15 or the azimuth angle driver 16 may be fixed or movable. Also, when positions of the focusing reflectors 19 are movable, the positions of the focusing reflectors 19 when the main reflector 11 is moved in multiple elevation angle directions in advance may be stored in the storage 174.

Also, the main reflector 11 is configured to form a paraboloid shape as a whole. However, other shapes including a spherical surface as a whole may be formed. Also, in the case of other shapes, high efficiency of the antenna device 1 can be achieved by optimizing the position, orientation and shape of the sub-reflector 12 and the positions and orientations of the focusing reflectors 19.

Also, the antenna device 1 is configured to perform transmission and reception with the wave source 18 existing in the far field. However, limitation of performance to either transmission or reception is permissible.

This application claims the benefit of Japanese Patent Application No. 2018-221095, filed on Nov. 27, 2018, the entire disclosure of which is incorporated by reference herein.

REFERENCE SIGNS LIST

1 Antenna device
11 Main reflector
12 Sub-reflector
13 Primary emitter
14 Transceiver
15 Elevation angle driver
16 Azimuth angle driver
17 Controller
18 Wave source
19 Focusing reflector
121_1 to 121_N, **121_*n*** Sub-reflector panel
122_1 to 122_N, **122_*n*** Sub-reflector panel drive mechanism
123 Sub-reflector drive mechanism
171 Phase calculator
172 Attitude controller
173 Sub-reflector controller
174 Storage
201_1 to 201_N, **201_*n*, 202_*n*** Element electric-field vector
210, 220, 240 Resultant electric-field vector
231_1 to 231_N, **231_*n*** Element electric-field vector

The invention claimed is:

1. An antenna device comprising:
a main reflector;
a sub-reflector including sub-reflector panels and having a reflecting surface facing a reflecting surface of the main reflector;
a primary emitter to receive a radio wave reflected by the sub-reflector;
sub-reflector panel drive mechanisms coupled to and configured to drive the corresponding sub-reflector panels; and
a phase calculator to
calculate each of relative phases of element electric-field vectors on an aperture surface corresponding to panel areas of the main reflector that are irradiated with radio waves from the corresponding sub-reflector panels based on a change in received electric-field strength of the radio wave received by the primary emitter during driving of the sub-reflector panel drive mechanisms, and
determine positions of the sub-reflector panels at which a phase distribution on an aperture surface of the main reflector is minimized.

2. The antenna device according to claim 1, wherein
the phase calculator calculates, using a rotating element electric-field vector method and based on a change in the received electric-field strength of the radio wave received by the primary emitter when the sub-reflector panel drive mechanisms are finely driven, a relative phase of the element electric-field vector corresponding to each of the sub-reflector panels regarded as antenna elements.

3. The antenna device according to claim 1, wherein
after movement of the main reflector in an elevation direction, the phase calculator calculates the relative phase during driving of the sub-reflector panel drive mechanisms.

4. The antenna device according to claim 3, further comprising:
an attitude controller to
calculate an approximate curved surface from a shape of the main reflector, and
cause movement of the sub-reflector to a focal position of the curved surface,
wherein after the attitude controller moves the sub-reflector, the phase calculator calculates the relative phase during driving of the sub-reflector panel drive mechanisms.

5. The antenna device according to claim 3, further comprising:
an attitude controller to
determine a position of the sub-reflector at which the received electric-field strength has a maximum value, and
cause movement of the sub-reflector to the determined position,
wherein after the attitude controller moves the sub-reflector, the phase calculator calculates the relative phase during driving of the sub-reflector panel drive mechanisms.

6. An antenna device comprising:
a main reflector;
a sub-reflector including sub-reflector panels and having a reflecting surface facing a reflecting surface of the main reflector;
a primary emitter to receive a radio wave reflected by the sub-reflector;
sub-reflector panel drive mechanisms coupled to and configured to drive the corresponding sub-reflector panels;
a phase calculator to
calculate a relative phase of an element electric-field vector corresponding to each of the sub-reflector panels based on a change in received electric-field strength of the radio wave received by the primary emitter during driving of the sub-reflector panel drive mechanisms, and determine positions of the sub-reflector panels at which a phase distribution on an aperture surface of the main reflector is minimized; and a storage to store position information of positions of the sub-reflector panels that are determined by the phase calculator after moving the main reflector in elevation directions in advance, wherein the phase calculator determines the positions of the sub-reflector panels based on the position information stored in the storage and an elevation angle of the main reflector.

7. The antenna device according to claim 6, wherein the phase calculator calculates, using a rotating element electric-field vector method and based on a change in the received electric-field strength of the radio wave received by the primary emitter when the sub-reflector panel drive mechanisms are finely driven, a relative phase of the element electric-field vector corresponding to each of the sub-reflector panels regarded as antenna elements.

8. The antenna device according to claim 6, wherein after movement of the main reflector in an elevation direction, the phase calculator calculates the relative phase during driving of the sub-reflector panel drive mechanisms.

9. The antenna device according to claim 8, further comprising:

an attitude controller to calculate an approximate curved surface from a shape of the main reflector, and cause movement of the sub-reflector to a focal position of the curved surface, wherein after the attitude controller moves the sub-reflector, the phase calculator calculates the relative phase during driving of the sub-reflector panel drive mechanisms.

10. The antenna device according to claim 8, further comprising:

an attitude controller to determine a position of the sub-reflector at which the received electric-field strength has a maximum value, and cause movement of the sub-reflector to the determined position, wherein after the attitude controller moves the sub-reflector, the phase calculator calculates the relative phase during driving of the sub-reflector panel drive mechanisms.

11. The antenna device according to claim 6, further comprising:

one or more focusing reflectors between the sub-reflector and the primary emitter, wherein the radio wave reflected by the sub-reflector is reflected by the one or more focusing reflectors to focus on a phase center of the primary emitter.

12. An antenna device comprising:

a main reflector;

a sub-reflector including sub-reflector panels and having a reflecting surface facing a reflecting surface of the main reflector;

a primary emitter to receive a radio wave reflected by the sub-reflector;

sub-reflector panel drive mechanisms coupled to and configured to drive the corresponding sub-reflector panels;

a phase calculator to calculate a relative phase of an element electric-field vector corresponding to each of the sub-reflector panels based on a change in received electric-field strength of the radio wave received by the primary emitter during driving of the sub-reflector panel drive mechanisms, and determine positions of the sub-reflector panels at which a phase distribution on an aperture surface of the main reflector is minimized; and one or more focusing reflectors between the sub-reflector and the primary emitter, wherein the radio wave reflected by the sub-reflector is reflected by the one or more focusing reflectors to focus on a phase center of the primary emitter.

13. The antenna device according to claim 12, wherein the phase calculator calculates, using a rotating element electric-field vector method and based on a change in the received electric-field strength of the radio wave received by the primary emitter when the sub-reflector panel drive mechanisms are finely driven, a relative phase of the element electric-field vector corresponding to each of the sub-reflector panels regarded as antenna elements.

14. The antenna device according to claim 12, wherein after movement of the main reflector in an elevation direction, the phase calculator calculates the relative phase during driving of the sub-reflector panel drive mechanisms.

15. The antenna device according to claim 14, further comprising:

an attitude controller to calculate an approximate curved surface from a shape of the main reflector, and cause movement of the sub-reflector to a focal position of the curved surface, wherein after the attitude controller moves the sub-reflector, the phase calculator calculates the relative phase during driving of the sub-reflector panel drive mechanisms.

16. The antenna device according to claim 14, further comprising:

an attitude controller to determine a position of the sub-reflector at which the received electric-field strength has a maximum value, and cause movement of the sub-reflector to the determined position, wherein after the attitude controller moves the sub-reflector, the phase calculator calculates the relative phase during driving of the sub-reflector panel drive mechanisms.

17. An antenna adjustment method of an antenna device including a main reflector, a sub-reflector including sub-reflector panels, and a primary emitter to receive a radio wave reflected by the sub-reflector, the method comprising:

calculating, based on a change in received electric-field strength of the radio wave received by the primary emitter during changes of positions of the sub-reflector panels, each off relative phases of element electric-field vectors on an aperture surface corresponding to panel areas of the main reflector that are irradiated with radio waves from the corresponding sub-reflector panels; and determining positions of the sub-reflector panels at which a phase distribution on an aperture surface of the main reflector is minimized.

* * * * *